United States Patent [19]

Kylmänen

[11] 4,127,757

[45] Nov. 28, 1978

[54] CONTACT DEVICE FOR AN ELECTRIC SWITCH

[75] Inventor: Jouko Kylmänen, Vaasa, Finland

[73] Assignee: OY. Stromberg AB., Vaasa, Finland

[21] Appl. No.: 789,595

[22] Filed: Apr. 21, 1977

[30] Foreign Application Priority Data

Apr. 27, 1976 [FI] Finland ..... 761163

[51] Int. Cl.[2] ..... H01H 1/42

[52] U.S. Cl. ..... 200/254; 200/258

[58] Field of Search ..... 200/254, 258, 286, 287, 200/16 F, 16 D

[56] References Cited

U.S. PATENT DOCUMENTS

| | | | |
|---|---|---|---|
| 4,016,377 | 4/1977 | Iwaski | 200/254 |
| 4,025,747 | 5/1977 | Bharteey et al. | 200/254 |

*Primary Examiner*—George T. Hall

*Attorney, Agent, or Firm*—Ladas, Parry, Von Gehr, Goldsmith & Deschamps

[57] ABSTRACT

A contact device for an electric switch comprising at least two interconnectable contacts and at least two contact knives movable relative thereto and adapted, in the closed position of the switch, to clamp between themselves at least one of the contacts. The contact knives are enclosed in pairs by iron elements or similar which, when a short-circuit current passes through the contact knives, act as a magnets increasing the contact force.

3 Claims, 7 Drawing Figures

CONTACT DEVICE FOR AN ELECTRIC SWITCH

This invention relates to a contact device for an electric switch having an open and a closed position, comprising:

at least two interconnectable contacts, and at least two contact knives movable relative to said contacts and arranged, in said closed position of the switch, to clamp between themselves at least one of said contacts.

The quality requirements concerning the contacts in a switch are numerous, one of the most difficult ones being the requirement for a sufficient resistance to short-circuiting and especially for the ability to close a short-circuit current. This difficulty is particularly pronounced in switches under 1000 V, the outer dimensions of which are small. The problem is that the short-circuit current "pushes" itself through a few points at the contact site of the switch which results in a force tending to open the switch, said force being proportional to the square of the short-circuit current and amounting to thousands of newtons in short-circuit currents appearing in practice.

This problem has long since been recognized and a number of solutions have been developed. Without exception the basic idea is to compensate this force by designing the circuit of the contact device so that the short-circuit current passing therethrough generates a force component opposite to the force tending to open the contacts, said opposite force striving at keeping the contacts closed with the aid of contact springs always included in a contact device and generating a static force.

The construction of a fully sufficient compensation has proved to be difficult, wherefore the resistance to short-circuit in most structures is based, in addition to said compensation, on the use of relatively strong contact springs and several parallel contacts. This easily results in a complicated, expensive and sometimes perhaps even an unduly strong structure.

In spite of this, in many structures, their limit of resistance is reached already with a short-circuit current corresponding to practical conditions: the short-circuit current slightly opens the contacts, they spark, may be welded together and even be destroyed.

It is the object of the present invention to provide a contact device which, provided with relatively strong contact springs, is able to resist short-circuit currents appearing in practice both in the closed position and when closing a short-circuited circuit.

The contact device according to the invention comprises magnetic metal elements enclosing said contact knives in pairs such that when a short-circuit current passes through said contact knives, said metal elements act as magnets increasing the contact force.

Specific embodiments or the contact device according to the invention are characterized by the constructions defined in claim 2 and 3.

The invention will now be described in more detail, reference being made to the embodiment according to the accompanying drawings.

Figure 1:
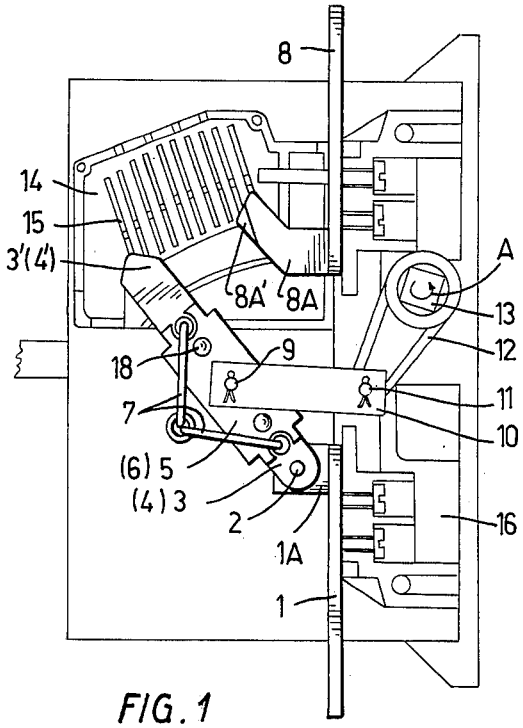
FIGS. 1 and 2 are side and front views, respectively, of the device according to the invention in the "switch open" position.
Figure 2:
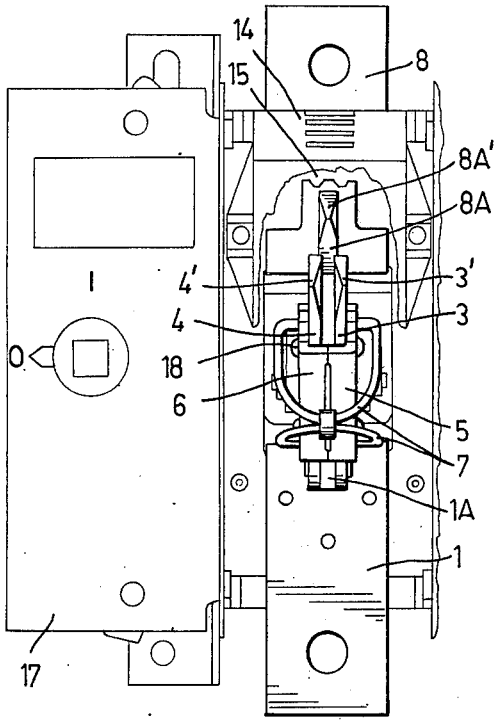
Figure 3:
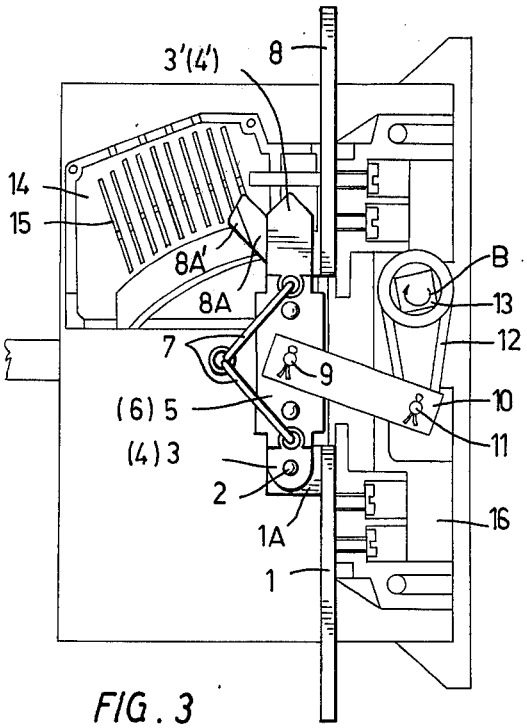
FIGS. 3 and 4 are side and front views, respectively, of the device according to the invention in the "switch closed" position.
Figure 4:
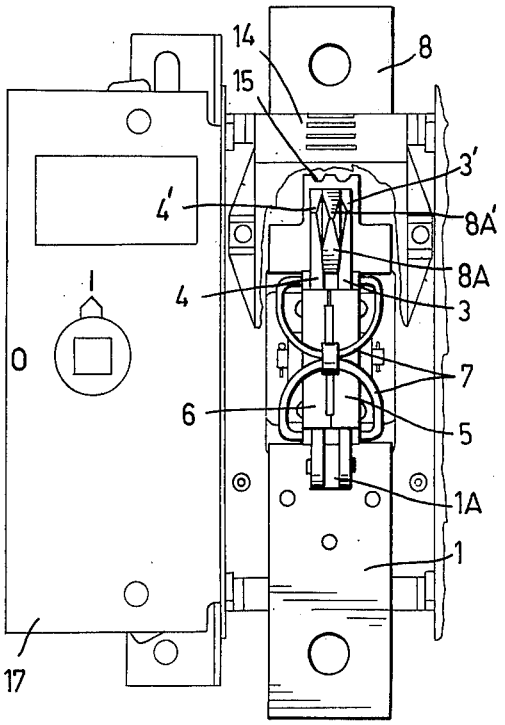

Fixed contacts 1 and 8 are fastened to a frame made of isolating material. Movable contact knives 3 and 4 sprung by rings 7 are via a hinge piece 1A journalled to the contact 1 and iron elements 5 and 6 made of steel are fastened to the contact knives 3 and 4, said iron elements forming around the knives 3 and 4 an iron circuit acting as a magnet. Conveniently, the iron elements 5, 6 consist of two bodies connected by rivets 18, bolts or similar fastening members to the contact knives 3, 3' and 4 4'. A portion 8A fixed to the contact 8 is located in a disconnection chamber 14 provided with quenching plates 15.

When guiding the switch from the open position to the closed position, a shaft 13 is rotated by means of a steering device (not shown) in the direction of arrow A (FIG. 1). The contact knives 3 and 4 are hereby moved by levers 10 and 12 so that their point portions 3' and 4' meet (or diverge when guiding to the open position) at the bevelled area 8A' of the contact body 8A. Thus, the fire marks produced in the contacts when closing or disconnecting the current are not formed on the opposite "areas of continuous contact" in the closed position of the switch.

In its simple form, i.e., without iron elements 5 and 6, the knife contact is known per se. In this embodiment, the short-circuit current passing through the contact produces between the contact knives a force holding them closed and, accordingly, improves the resistance against short-circuit of the contacts. When a high short-circuit is involved, this is not sufficient. The iron circuit 5, 6, on the other hand, considerably increases the force holding the contacts closed.

Particularly when closing a high short-circuit current, the iron circuit is of a decisive importance. If there is no iron circuit, the force holding the knife contacts closed is generated only when a current is passing in both knives. It is very difficult to close the knife contact so that both knives would close exactly simultaneously, primarily due to the tolerances in the structures used in practice. This phenomenon is aggravated by an eventual lateral bounce of the knife caused by a concussive first contact.

When the contact knives 3 and 4 are encircled by the iron circuit 5 and 6, the short-circuit current immediately produces the desired force effect, if only at least one of the knives meets the point portion 8 A' of the fixed contact. Also the other knife then closes quickly, the current is balanced to pass through both knives, and the force holding the contacts closed reaches its highest effect quickly and without oscillating.

The iron circuit 5, 6 improves the resistance against short-circuiting of the contact also because it stiffens the usually fairly weak contact knives made of copper against the effect of the short-circuiting forces producing bending and oscillations.

Figure 5:
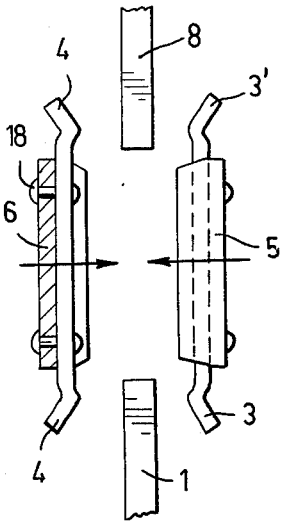
FIGS. 5, 6 and 7 are schematic views of three different alternatives of movement of the contact device.
Figure 6:
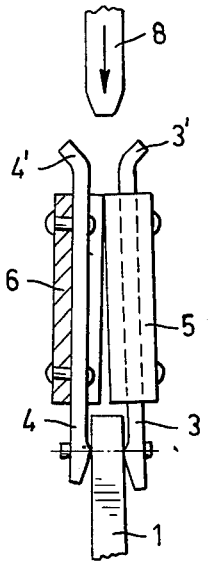
Figure 7:
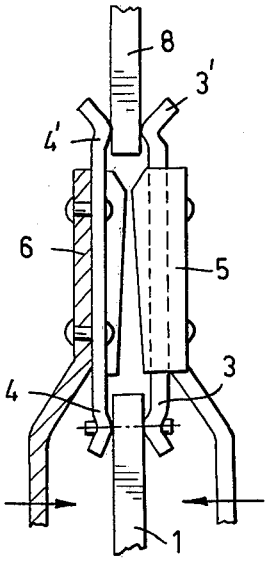

It is apparent that the structure shown can be varied in many ways within the scope of the invention. It is, however, essential that the contact be composed of at least two parallel contact knives pressing against the contact located between them and being encircled in pairs by an effective iron circuit. The movement of the contacts can be arranged in many ways, e.g., as shown in FIGS. 5, 6, and 7. Thus, in the embodiment according to FIG. 5, the knives which are free at their both ends 3, 3', 4, 4' and provided with the iron circuit 5, 6 are adapted to enclose between themselves the fixed contacts 1, 8.

In the embodiment according to FIG. 6, the knives are at one end 3, 4 pivoted to the fixed contact 1, whereby the movable contact 8 provided with bevelled surfaces is adapted to penetrate between the other, free contact ends 3', 4' of the knives.

In the embodiment according to FIG. 7, the contacts 1 and 8 are fixed, but the knives are at one end 3, 4 pivoted to the contact 1, making at the other end 3', 4' contact with the fixed contact 8 by means of a pincer-like movement.

What I claim is:

1. A contact device for an electric switch having an open and a closed position, comprising:

at least two interconnectable contacts;

at least two contact knives movable relative to said contacts and arranged, in said closed position of the switch, to clamp between themselves at least one of said contacts; and magnetic metal elements enclosing said contact knives in pairs such that when a short-circuit current passes through said contact knives, said metal elements act as magnets increasing the contact force.

2. A contact device as claimed in claim 1, wherein each metal element consists of two bodies connected by means of fastening members, e.g., rivets, to the contact knives.

3. A contact device as claimed in claim 1, wherein said metal elements are iron elements.

* * * * *